US009556705B2

(12) United States Patent
Mitchell

(10) Patent No.: US 9,556,705 B2
(45) Date of Patent: Jan. 31, 2017

(54) CASING JOINT ASSEMBLY FOR PRODUCING AN ANNULUS GAS CAP

(71) Applicant: Landmark Graphics Corporation, Houston, TX (US)

(72) Inventor: Robert F Mitchell, Lookout Mountain, GA (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 14/502,800

(22) Filed: Sep. 30, 2014

(65) Prior Publication Data

US 2015/0041140 A1 Feb. 12, 2015

Related U.S. Application Data

(63) Continuation of application No. 14/389,589, filed as application No. PCT/US2013/054075 on Aug. 8, 2013.

(51) Int. Cl.

| | |
|---|---|
| ***E21B 34/14*** | (2006.01) |
| ***E21B 34/06*** | (2006.01) |
| ***E21B 33/00*** | (2006.01) |
| ***E21B 34/00*** | (2006.01) |

(52) U.S. Cl.
CPC ..... *E21B 34/06* (2013.01); *E21B 33/00* (2013.01); *E21B 34/00* (2013.01)

(58) Field of Classification Search
USPC ..... 166/332.1, 75.13, 90.1
See application file for complete search history.

(56) References Cited

U.S. PATENT DOCUMENTS

| | | | | |
|---|---|---|---|---|
| 4,354,554 | A * | 10/1982 | Calhoun | E21B 33/12 166/105.5 |
| 2005/0230121 | A1* | 10/2005 | Martinez | E21B 43/124 166/372 |
| 2006/0137881 | A1* | 6/2006 | Schmidt et al. | 166/372 |

* cited by examiner

*Primary Examiner* — Taras P Bemko
(74) *Attorney, Agent, or Firm* — Crain, Caton & James; Tenley Krueger

(57) ABSTRACT

A casing joint assembly and methods for producing an annulus gas cap using the casing joint assembly. The casing joint assembly comprises a first valve and a second valve to control fluid pressure in the sealed annulus between the casing string and a wall of the well bore or another casing string.

11 Claims, 2 Drawing Sheets

CASING JOINT ASSEMBLY FOR PRODUCING AN ANNULUS GAS CAP

CROSS-REFERENCE TO RELATED APPLICATIONS

This application is a continuation of U.S. patent application Ser. No. 14/389,589, which is incorporated herein by reference, and claims the priority of PCT Patent Application Serial No. PCT/US13/54075, filed on Aug. 8, 2013, which is incorporated herein by reference.

STATEMENT REGARDING FEDERALLY SPONSORED RESEARCH

Not applicable.

FIELD OF THE DISCLOSURE

The present disclosure generally relates to a casing joint assembly and methods for producing an annulus gas cap using the casing joint assembly.

BACKGROUND

A natural resource such as oil or gas residing in a subterranean formation can be recovered by drilling a well into the formation. The subterranean formation is usually isolated from other formations using a technique known as cementing. In particular, a well bore is typically drilled down to the subterranean formation while circulating a drilling fluid through the well bore. After the drilling is terminated, a string of pipe (e.g. casing string) is run in the well bore. Primary cementing is then usually performed whereby a cement slurry is pumped down through the casing string and into the annulus between the casing string and the wall of the well bore or another casing string to allow the cement slurry to set into an impermeable cement column and thereby fill a portion of the annulus. Sealing the annulus typically occurs near the end of cementing operations after well completion fluids, such as spacer fluids and cements, are trapped in place to isolate these fluids within the annulus from areas outside the annulus. The annulus is conventionally sealed by closing a valve, energizing a seal, and the like.

After completion of the cementing operations, production of the oil or gas may commence. The oil and gas are produced at the surface after flowing through the casing string. As the oil and gas pass through the casing string, heat may be passed from such fluids through the casing string into the annulus. As a result, thermal expansion of the fluids in the annulus above the cement column causes an increase in pressure within the annulus also known as annular pressure buildup. Annular pressure buildup typically occurs because the annulus is sealed and its volume is fixed. Annular pressure buildup may cause damage to the well bore such as damage to the cement sheath, the casing, tubulars, and other equipment. In addition, annular pressure buildup makes proper casing design difficult if not impossible. Because the fluid pressures may be different in the annulus for each well bore, use of a standard casing design may not be practical. In order to control annular pressure buildup, conventional methods circulate gas into place during cementing operations. Because the gas is mobile, it is difficult to place the gas in the proper location and, at the same time, control the fluid pressure in the annulus. If, for example, the gas is placed too far below the top of the annulus, the rising gas will increase the pressure in the annulus.

Other techniques to control annular pressure buildup include pressure relieving/reducing methods, such as using syntactic foam wrapping on the casing string, placing nitrified spacer fluids above the cement column in the annulus, placing rupture disks in another, outer, casing string, designing "shortfalls" in the primary cementing operations, such as designing the top of the cement column in an annulus to be short of the previous casing shoe, and using hollow spheres. However, such techniques have drawbacks. For instance, the syntactic foam may cause flow restrictions during primary cementing operations. In addition, the syntactic foam may detach from the casing string and/or become damaged as the casing string is installed, Drawbacks with placing the nitrified spacer fluids include logistical difficulties (e.g., limited room for the accompanying surface equipment), pressure limitations on the well bore, and the typical high expenses related thereto. Further drawbacks with placing the nitrified spacer fluids include loss of returns when circulating the nitrified spacer into place and in situations wherein the geographic conditions provide difficulties in supplying the proper equipment for pumping the nitrified spacer. Additional drawbacks include failure of rupture disks that may prevent well bore operations from being able to proceed. Further drawbacks include the designed "shortfall," which may not occur due to well bore fluids not being displaced as designed and cement channeling up to a casing shoe and trapping it. Moreover, problems with the hollow spheres include the spheres failing before placement in the annulus.

BRIEF DESCRIPTION OF THE DRAWINGS

The present disclosure is described below with references to the accompanying drawings in which like elements are referenced with like reference numerals, and in which.

DETAILED DESCRIPTION OF THE PREFERRED EMBODIMENTS

The present disclosure therefore, overcomes one or more deficiencies in the prior art by providing a casing joint assembly and methods for producing an annulus gas cap using the casing joint assembly.

SUMMARY OF THE INVENTION

In one embodiment, the present disclosure includes a casing joint assembly, which comprises: i) a casing joint with a casing joint wall; ii) a first valve positioned through an opening in the casing joint wall; iii) a second valve positioned through another opening in the casing joint wall; and iv) wherein one of the first valve and the second valve permits gas to enter an annulus between a wellbore from a workstring.

In another embodiment, the present disclosure includes a casing joint assembly, which comprises: i) a casing joint; ii) a first valve positioned through an opening in the casing joint; iii) a second valve positioned through another opening in the casing joint wherein the first valve is positioned above the second valve relative to an opening at one end of the casing joint assembly and the second valve is positioned below the first valve relative to an opening at another end of the casing joint assembly; iv) a valve actuator operatively connecting the first valve and the second valve; v) a seal assembly positioned around the one end of the casing joint assembly or around a casing string section connected to the one end of the casing joint assembly; vi) a cement column positioned around the another end of the casing joint assembly or around another casing string section connected to the another end of the casing joint assembly, the casing string section, the another casing string section and the casing joint assembly forming a casing string; and vii) wherein the seal assembly, the cement column, the casing joint assembly and the another casing string or a wall of a well bore form an annulus between the casing joint assembly and the well bore wall or the another casing string that is sealed when the first valve and the second valve are closed.

In the following detailed description of the preferred embodiments, references to the accompanying drawings that form a part hereof, and in which is shown by way of illustration specific preferred embodiments in which the invention may be practiced. These embodiments are described in sufficient detail to enable those skilled in the art to practice the invention, and it is to be understood that other embodiments that may be utilized and that logical changes may be made without departing from the spirit and scope of the present disclosure. The claimed subject matter thus, might also be embodied in other ways, to include structures, steps and combinations similar to the ones described herein, in conjunction with other present or future technologies. The following detailed description is therefore, not to be taken in a limiting sense, and the scope of the present disclosure is defined only by the appended claims.

Figure 1:
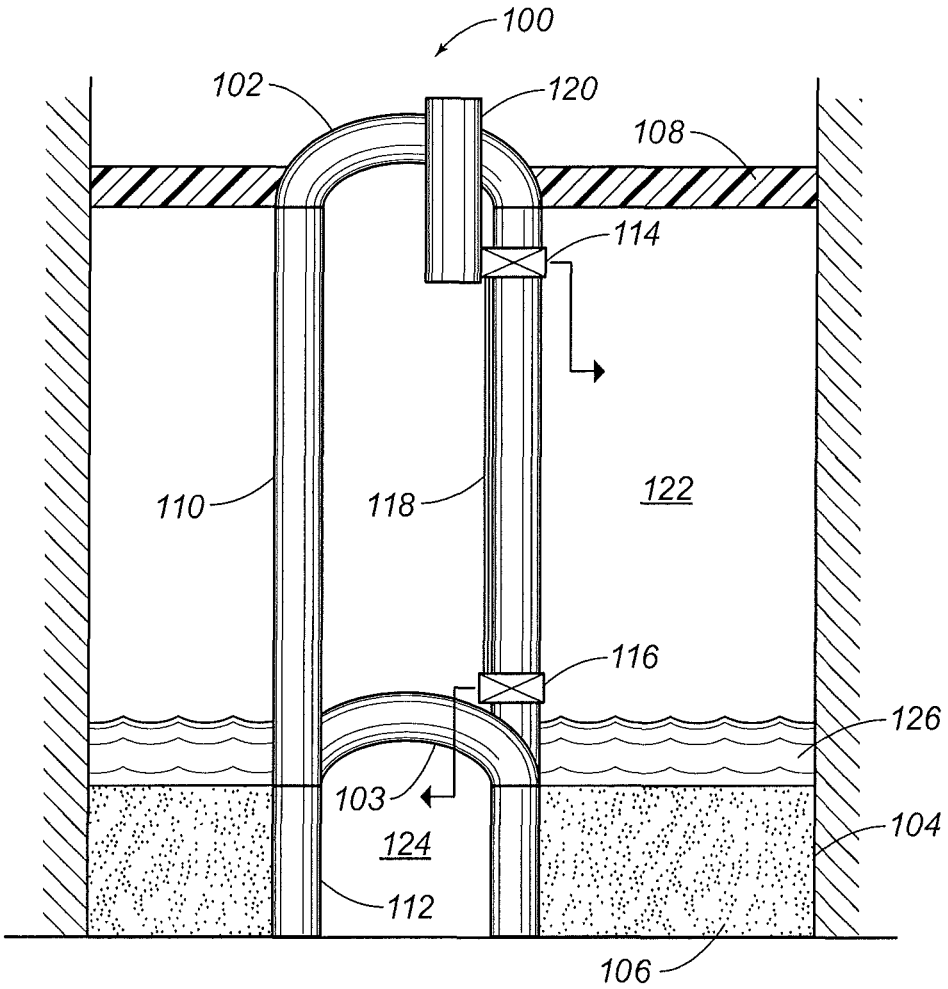
FIG. 1 is a cross-sectional, elevation view illustrating a well bore and an upper end of a casing string comprising one embodiment of a casing joint assembly for producing an annulus gas cap.
Figure 2:
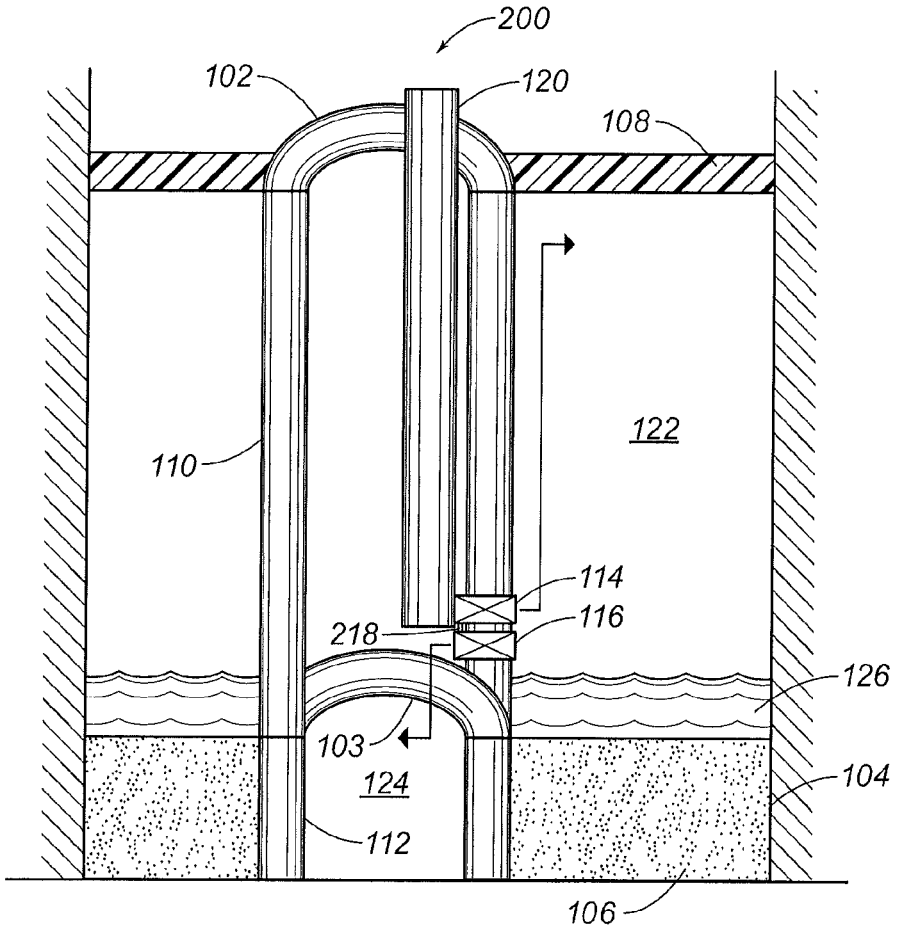
FIG. 2 is a cross-sectional, elevation view illustrating a well bore and an upper end of a casing string comprising another embodiment of a casing joint assembly for producing an annulus gas cap.

Referring now to FIGS. 1-2, the cross-sectional, elevation views illustrate different embodiments of a casing joint assembly 100, 200 for producing an annulus gas cap. An upper end of a casing string comprises the casing joint assembly 100, 200 which is open at one end 102 and is connected to a casing joint 112 at another end 103. Alternatively, the casing joint assembly 100, 200 may be connected at the one end 102 to another casing joint (not shown) when the casing joint assembly 100, 200 is not positioned at the upper end of the casing string. The casing string is substantially secured within a well bore by a cement column 106 positioned around the casing string near the another end 103 of the casing joint assembly 100, 200. The casing joint assembly 100, 200 comprises a casing joint wall 110, a first valve 114, a second valve 116 and a valve actuator 118, 218. The first valve 114 is preferably positioned above the second valve 116, however, the first valve 114 may be positioned below the second valve 116. The first valve 114 passes through an opening in the casing joint wall 110 and restricts fluid communication between a sealed annulus 122 in the well bore and an annulus 124 in the casing string. Likewise, the second valve 116 passes through an opening in the casing joint wall 110 and restricts fluid communication between the sealed annulus 122 in the well bore and the annulus 124 in the casing string. The first valve 114 and the second valve 116 may be any conventional valve suitable in size and operation for the purposes described herein such as, for example, valves used in staged cementing operations. The first valve 114 and the second valve 116 are connected by the valve actuator 118, 218, which may be any conventional mechanical, pneumatic, hydraulic and/or electric actuator capable of opening the first valve 114 and the second valve 116 at the same time or at different times and closing the first valve 114 and the second valve 116 at the same time or at different times. The casing joint wall 110 is preferably the same size and dimension as every other casing joint wall in the casing string, however, may vary therefrom for purposes of stability, receipt of the first valve 114 and the second valve 116, and separation of the first valve 114 and the second valve 116. The casing joint assembly 100, 200 therefore, may be made from any conventional casing joint using conventional valves and valve connections with minor adjustments in size and/or dimension.

The sealed annulus 122 in the well bore is formed by the casing joint wall 110, which includes the first valve 114 and the second valve 116, the cement column 106, a wall 104 of the well bore or another casing string (not shown), and a seal assembly 108. The seal assembly 108 may be positioned around the one end 102 of the casing joint assembly 100, 200 to prevent fluid communication between the sealed annulus 122 in the well bore and the annulus 124 in the casing string other than through the first valve 114 and the second valve 116. Alternatively, the seal assembly 108 may be positioned anywhere around the casing string above the casing joint assembly 100, 200 for the same purpose when the casing joint assembly 100, 200 is not positioned at the upper end of the casing string. The seal assembly 108 may be any conventional mechanical means capable of preventing fluid communication between the sealed annulus 122 in the well bore and the annulus 124 in the casing string other than through the first valve 114 and the second valve 116. For example, a conventional packer may be used for the seal assembly 108. After conventional cementing operations, the sealed annulus 122 in the well bore contains drilling fluid 126. The drilling fluid 126 substantially fills the sealed annulus 122 in the well bore and increases pressure in the sealed annulus 122 due to thermal expansion of the drilling fluid 126 in the sealed annulus 122. Because drilling fluid is not very compressible, pressures as high as 10,000 psi above the hydrostatic pressure have been predicted. In conventional casing strings, the increased fluid pressure in the sealed annulus between the casing string and a wall of the well bore or another casing string make proper casing design difficult if not impossible. As demonstrated by the following description of the use and operation of the casing joint assembly 100, 200, fluid pressures and temperatures in the sealed annulus 122 may be substantially controlled and maintained.

In operation, a work string 120 is lowered into the casing string through the one end 102 of the casing joint assembly 100, 200 after cementing operations. The work string 120 is then connected to the first valve 114 and the valve actuator 118, 218 by any mechanical means well known in the art. The work string 120 is used to open the first valve 114 and the second valve 116 with the valve actuator 118, 218. Although the work string 120 is connected to the first valve 114 in FIGS. 1-2, it may be connected to the second valve 116 to perform the same functions in substantially the same manner as described in reference to FIGS. 1-2. The work string 120 may be any tubular member or regular drill string tubing with the mechanical means at a lower end to connect to the first valve 114 and the valve actuator 118, 218. A compressible gas such as, for example, nitrogen, neon, argon or helium or a foam is injected into the work string 120 from a source at a surface of the well bore, which enters the sealed annulus 122 in the well bore through the opened first valve 114. Other non-corrosive, inexpensive gases may be used, however, nitrogen is preferred. The drilling fluid 126 in the sealed annulus 122 is displaced by the gas or foam as the gas or foam enters the sealed annulus 122 in the well bore. The displaced drilling fluid 126 thus, enters the annulus 124 in the casing string through the opened second valve 116.

The first valve 114 and the second valve 116 may be positioned farther apart as illustrated in FIG. 1 compared to the position of the first valve 114 and the second valve 116 in FIG. 2. The casing joint assembly 200 in FIG. 2 thus, requires the gas or foam injected into the sealed annulus 122 to travel up through the drilling fluid 126 until the drilling fluid 126 is substantially displaced. Conversely, the casing joint assembly 100 in FIG. 1 does not require the gas or foam injected into the sealed annulus 122 to travel up through the drilling fluid 126 until the drilling fluid 126 is substantially displaced. The gas or foam injected into the sealed annulus 122 may, however, be required to travel up through the drilling fluid 126 until the drilling fluid 126 is substantially displaced if the seal assembly 108 is positioned anywhere around the casing string above the casing joint assembly 100 in FIG. 1. In either embodiment, a known amount of drilling fluid 126 will remain in the sealed annulus 122 below the second valve 116 as shown in FIGS. 1-2. Therefore, the position of the second valve 116 is preferably as low as possible in the casing joint wall 110.

After a predetermined amount of gas or foam is injected into the sealed annulus 122, which cannot exceed the volume of the sealed annulus 122 above the second valve 116 and is preferably equal to the volume of the sealed annulus 122 above the second valve 116, the first valve 114 and the second valve 116 are closed by the work string 120 with the same means used to open the first valve 114 and the second valve 116. In this manner, a gas cap is created in the sealed annulus 122. Because the sealed annulus 122 is a known volume at a known position in the well bore, the annulus gas cap may be properly positioned and used to substantially control and maintain fluid pressures and temperatures in the sealed annulus 122.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A casing joint assembly, which comprises:

a casing joint with a casing joint wall;

a first valve positioned through an opening in the casing joint wall;

a second valve positioned through another opening in the casing joint wall; and wherein one of the first valve and the second valve permits gas to enter an annulus between a wellbore wall and the casing joint assembly through a workstring extending into the casing joint.

2. The casing joint assembly of claim 1, wherein the first valve is positioned above the second valve relative to an opening at one end of the casing joint assembly and the second valve is positioned below the first valve relative to an opening at another end of the casing joint assembly.

3. The casing joint assembly of claim 2, further comprising a seal assembly positioned around the one end of the casing joint assembly or around a casing string section connected to the one end of the casing joint assembly.

4. The casing joint assembly of claim 3, further comprising a cement column positioned around the another end of the casing joint assembly or around another casing string section connected to the another end of the casing joint assembly, the casing string section, the another casing string section and the casing joint assembly forming a casing string.

5. The casing joint assembly of claim 4, wherein the seal assembly, the cement column, the casing joint assembly and the another casing string or a wall of a well bore form the annulus in the well bore that is sealed when the first valve and the second valve are closed.

6. The casing joint assembly of claim 5, wherein the first valve and the second valve form a first fluid passage and second fluid passage, respectively, between the annulus in the well bore and another annulus in the casing string when the first valve and the second valve are open.

7. The casing joint assembly of claim 1, further comprising a valve actuator operatively connecting the first valve and the second valve.

8. The casing joint assembly of claim 7, wherein the valve actuator is a mechanical, pneumatic, hydraulic or electric actuator.

9. A casing joint assembly, which comprises:

a casing joint;

a first valve positioned through an opening in the casing joint;

a second valve positioned through another opening in the casing joint wherein the first valve is positioned above the second valve relative to an opening at one end of the casing joint assembly and the second valve is positioned below the first valve relative to an opening at another end of the casing joint assembly;

a valve actuator operatively connecting the first valve and the second valve;

a seal assembly positioned around the one end of the casing joint assembly or around a casing string section connected to the one end of the casing joint assembly;

a cement column positioned around the another end of the casing joint assembly or around another casing string section connected to the another end of the casing joint assembly, the casing string section, the another casing string section and the casing joint assembly forming a casing string; and wherein the seal assembly, the cement column, the casing joint assembly and the another casing string or a wall of a well bore form an annulus between the casing joint assembly and the well bore wall or the another casing string that is sealed when the first valve and the second valve are closed.

10. The casing joint assembly of claim 9, wherein the first valve and the second valve form a first fluid passage and second fluid passage, respectively, between the annulus in the well bore and another annulus in the casing string when the first valve and the second valve are open.

11. The casing joint assembly of claim 9, wherein the valve actuator is a mechanical, pneumatic, hydraulic or electric actuator.

* * * * *